US008136632B2

(12) United States Patent
Gabriel

(10) Patent No.: US 8,136,632 B2
(45) Date of Patent: Mar. 20, 2012

(54) COLLAPSIBLE PLATFORM ASSEMBLY FOR A LADDER

(75) Inventor: Edward J. Gabriel, Morton Grove, IL (US)

(73) Assignee: Edward J. Gabriel, Morton Grove, IL (US)

( * ) Notice: Subject to any disclaimer, the term of this patent is extended or adjusted under 35 U.S.C. 154(b) by 387 days.

(21) Appl. No.: 12/170,480

(22) Filed: Jul. 10, 2008

(65) Prior Publication Data

US 2010/0006374 A1 Jan. 14, 2010

(51) Int. Cl.
*E06C 1/38* (2006.01)

(52) U.S. Cl. ..... 182/116; 182/214; 182/107

(58) Field of Classification Search ..... 182/107, 182/214, 116

See application file for complete search history.

(56) References Cited

U.S. PATENT DOCUMENTS

| | | | | | |
|---|---|---|---|---|---|
| 217,539 | A | * | 7/1879 | Kellogg | 182/116 |
| 309,435 | A | | 12/1884 | Bodell | |
| 404,511 | A | * | 6/1889 | Tully | 182/206 |
| 434,462 | A | | 8/1890 | Raber | |
| 988,593 | A | * | 4/1911 | Poss | 182/95 |
| 1,015,123 | A | * | 1/1912 | Bauer | 182/123 |
| 1,474,250 | A | * | 11/1923 | Folliard | 182/123 |
| 1,645,879 | A | * | 10/1927 | Skeels | 182/121 |
| 2,035,537 | A | * | 3/1936 | Cowan et al. | 182/39 |
| 2,535,544 | A | * | 12/1950 | McKinley | 182/85 |
| 2,592,006 | A | | 4/1952 | Burke | |
| 2,708,064 | A | * | 5/1955 | McGowen | 182/39 |
| 2,881,028 | A | * | 4/1959 | Baird | 182/116 |
| 3,318,415 | A | * | 5/1967 | Christie, Sr. | 182/116 |
| 3,963,095 | A | | 6/1976 | Hedges | |
| 4,157,742 | A | * | 6/1979 | Aanensen | 182/97 |
| 4,253,547 | A | | 3/1981 | Skaalen et al. | |
| 4,450,935 | A | * | 5/1984 | Gustavus | 182/45 |
| 4,491,196 | A | | 1/1985 | Bocker | |

(Continued)

FOREIGN PATENT DOCUMENTS

GB 2 224 300 A 5/1990

(Continued)

*Primary Examiner* — Alvin Chin Shue
*Assistant Examiner* — Daniel Cahn
(74) *Attorney, Agent, or Firm* — John S. Paniaguas; Katten Muchin Rosenman LLP

(57) ABSTRACT

A collapsible platform assembly for an extension ladder is disclosed that can be used to support the top of an extension ladder with respect to a roof. The collapsible platform assembly includes a platform that is rotatably connected to a rung of an extension ladder near the top. In a storage or retracted position, the platform is generally co-planar with the ladder; i.e fits between the side rails of the extension ladder. In a use position, the platform can be extended and directly supported by the roof, either flat against a roof or alternatively at an acute angle relative to the roof. Since the platform is configured to be directly supported by the roof, the platform acts as a rigid support for the top of the ladder which does not deflect under load as there is an even weight transfer from the ladder to the platform in use. In accordance with an important aspect of the invention, an upper portion of the side rails act as "grab rails" when the platform is in an extended position, allowing the user to hold on and walk through the top of the ladder and onto the platform when the collapsible platform assembly is in an extended position. In one embodiment of the invention, one or more retractable hand rails are provided for added safety for use when the user moves onto the platform.

4 Claims, 5 Drawing Sheets

U.S. PATENT DOCUMENTS

| | | | | | |
|---|---|---|---|---|---|
| 4,552,247 | A | * | 11/1985 | Purdy | 182/116 |
| 5,624,006 | A | * | 4/1997 | Richardson, Jr. | 182/45 |
| 5,911,287 | A | * | 6/1999 | Campbell | 182/103 |
| 5,924,521 | A | * | 7/1999 | Crockett | 182/95 |
| 6,394,229 | B1 | | 5/2002 | Hastreiter | |
| 6,513,625 | B1 | | 2/2003 | Gaskins | |
| 6,533,069 | B1 | | 3/2003 | Couillard | |
| 2007/0267251 | A1 | | 11/2007 | Poldman | |

FOREIGN PATENT DOCUMENTS

| | | | |
|---|---|---|---|
| GB | 2 261 906 | A | 6/1993 |
| GB | 2 387 868 | A | 10/2003 |
| JP | 2002038708 | | 2/2002 |

* cited by examiner

COLLAPSIBLE PLATFORM ASSEMBLY FOR A LADDER

BACKGROUND OF THE INVENTION

1. Field of the Invention

The present invention relates to a collapsible platform assembly for an extension ladder and more particularly to a collapsible platform assembly rotatably secured near the top of an extension ladder having a platform for supporting a person, having a storage or retracted position in which the platform is generally co-planar with the ladder which allows it to be easily stored and transported as an extension ladder and an extended position in which the platform can be extended and directly supported by the roof, which define grab rails that extend beyond the height of the roof and allow a user to walk through the top of the ladder when the collapsible platform assembly is in an extended position and optionally includes a pair of retractable handrails for added safety for use when the user is on the platform.

2. Description of the Prior Art

Various devices are known in the art for attachment onto an extension ladder. For example, U.S. Pat. Nos. 309,435; 404,511; 434,462; 1,645,879; 2,035,537; 2,592,006; 3,963,095; 6,394,229; 6,513,625; and 6,533,069 as well as U.S. patent application No. U.S. 2007/0267251 A1. British patents GB 2 261 906 and GB 2 387 868 also disclose devices for attachment to extension ladders for various purposes.

U.S. Pat. Nos. 1,645,879; 2,592,006; 6,394,229 as well as U.S. patent application publication No. U.S. 2007/0267251 A1 and British Patent No. GB 2 387 868 all disclose devices for attachment to an extension ladder which are used to prevent the ladder from being supported by a gutter or roof edge. U.S. Pat. Nos. 6,513,625 and 6,533,069 also disclose devices for securing a ladder with respect to a roof or other structure.

U.S. Pat. No. 309,405 relates to a removable platform that can be removably attached to spaced apart rungs of the ladder and spaced away from the point of support of the ladder with respect to the roof. The platform for supporting a paint can or tools while a workman is on the ladder. The configuration of the device makes it unsuitable to act as a support point to support the ladder with respect to a roof or structure.

U.S. Pat. No. 404,511 discloses a device configured as a supplementary ladder which is rotatably connected on one end to an extension ladder with the opposing ends including hardware for enabling the supplementary ladder to be secured to a window sill on a building and provide support for the ladder relative to the window sill. The supplementary ladder is provided with hooks which allow one end of the supplementary ladder to be rotatably and removably connected to a rung on the extension ladder.

U.S. Pat. Nos. 434, 462, and 2,035,537 all disclose collapsible platform assemblies for attachment to extension ladders. In particular, U.S. Pat. No. 434,462, similar to U.S. Pat. No. 404,511, discloses a supplementary ladder rotatably connected to one rung on an extension ladder. The other end of the extension ladder includes a platform attached to a rung of the supplementary ladder. The platform covers a portion of an extending end of the supplementary ladder and is formed with two plates hinged together. In a use position, the plates are configured to be side by side. In a storage position, the hinges allow the platform to be folded in half. The supplementary ladder is configured to be folded up and stored between the side rails of the extension ladder when the supplementary ladder is not in use. In this storage position, the rungs in the supplementary ladder act as rungs for the extension ladder. The platform when folded in half unblocks one of the rungs on the supplementary ladder when the supplementary ladder is in a storage position. A pair of pivotally mounted clamps is used to secure the supplementary ladder in a storage position. These clamps when released allow the supplementary ladder to be extended. A pair of cords secures the free end of the supplementary ladder to a position adjacent the free end of the supplementary ladder in a use position. The supplementary ladder is spaced away from the top of the extension ladder to allow a workman to paint the side of a building beneath the roof.

U.S. Pat. No. 2,035,537 discloses a collapsible platform assembly that can be attached to one end of an extension ladder. The collapsible platform assembly is attached to the side rails of an extension ladder on one end by way brackets which allow the frame and the floor of the platform to be pivotally mounted thereto. The frame and the floor are also secured by way of chains which are bolted to the free ends of the extension ladder. The extension ladder is pivotally mounted to a truck. Support for the extension ladder is provided by a support ring on the truck. Thus, the collapsible platform is not configured to provide support of the ladder relative to a building or roof.

The devices discussed above for providing platforms for an extension ladder simply provide a platform for a workman to stand. These devices are not configured to enable the platform to contact a roof and provide support nor do these devices secure the ladder relative to the roof. The other devices discussed above likewise do not secure the ladder to the roof. As such, the devices described above do not satisfy certain government regulations. In particular, regulations have been developed that require ladders to be secured at the top to a support that will not "deflect" under load For example, OSHA Regulation 29 CFR 1926.1053(b)(1) states:

> "When portable ladders are used for access . . . , the ladder shall be secured at its top to rigid support that will not deflect . . . . In no case shall the extension be such that ladder deflection under a load, by itself, cause the ladder to slip off its support."

These regulations also require that the ladders have a "grasping device, such as a grab rail . . . to assist in mounting and dismounting the ladder." The devices discussed above, for example, as disclosed in U.S. Pat. Nos. 434,462 and 2,035,537, disclose utilize cords and chains and thus do not include grab rails. Thus, there is a need to provide a device for enabling the top of a ladder to be secured relative to the top of a roof. There is also a need to provide a device that includes grab rails and therefore complies with the government regulations.

SUMMARY OF THE INVENTION

The present invention relates to a collapsible platform assembly for an extension ladder that can be used to support the top of an extension ladder with respect to a roof. The collapsible platform assembly includes a platform that is rotatably connected to a rung of an extension ladder near the top. In a storage or retracted position, the platform is generally co-planar with the ladder; i.e fits between the side rails of the extension ladder. In a use position, the platform can be extended and directly supported by the roof, either flat against a roof or alternatively at an acute angle relative to the roof. Since the platform is configured to be directly supported by the roof, the platform acts as a rigid support for the top of the ladder which does not deflect under load as there is an even weight transfer from the ladder to the platform in use. In accordance with an important aspect of the invention, an upper portion of the side rails act as "grab rails" when the platform is in an extended position, allowing the user to hold on and walk through the top of the ladder and onto the platform when the collapsible platform assembly is in an extended position. In one embodiment of the invention, one or more retractable hand rails are provided for added safety for use when the user moves onto the platform.

DESCRIPTION OF THE DRAWING

These and other advantages of the present invention will be readily understood with reference to the following specification and attached drawing wherein.

DETAILED DESCRIPTION

The present invention relates to a collapsible platform assembly that can be used to support the top of an extension ladder with respect to a roof. The device is formed as a collapsible platform assembly that includes a platform that is rotatably connected to a rung of an extension ladder near the top. In a storage or retracted position, the platform is generally co-planar with the ladder; i.e fits between the side rails of the extension ladder. In a use position, the platform can be extended and directly supported by the roof, for example, generally parallel to the roof or alternatively at an acute angle relative to the roof. Since the platform is configured to be directly supported by the roof, the platform acts as a rigid support for the top of the ladder which does not deflect under load as there is an even weight transfer from the ladder to the roof when in use. In accordance with an important aspect of the invention, an upper portion of the side rails act as "grab rails" when the platform is in an extended position, allowing the user to hold on and walk through the top of the ladder and onto the platform. For added safety, one or more retractable hand rails may be provided for use when the user moves onto the platform.

Figure 4:
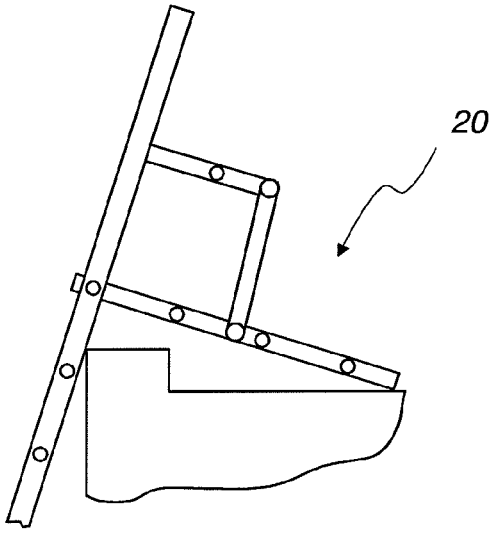
FIG. 4 is similar to FIG. 3 but illustrating an application of the invention on a flat roof with a perimeter wall.
Figure 5:
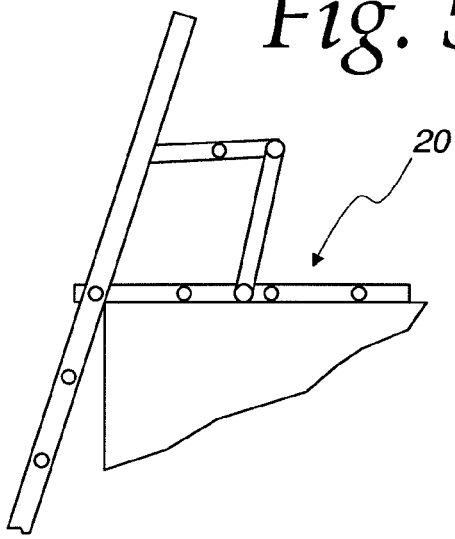
FIG. 5 is similar to FIG. 3 but illustrating an application of the invention on a flat roof.

The collapsible platform assembly is amenable to be used in all types of applications. For example, FIGS. 1, 3, 6 and 8 illustrate an application of the collapsible platform assembly in accordance with the present invention with respect to a gable roof FIGS. 4 and 5 illustrate an application of the collapsible platform assembly with respect to flat roofs. In particular, FIG. 4 illustrates an application of the collapsible platform assembly with respect to a flat roof with a perimeter wall, while FIG. 5 illustrates an application of the collapsible platform assembly with respect to a flat roof without a perimeter wall. Although not shown, the collapsible platform assembly is also adapted to be used in applications of other type roofs, such as gable roofs and other type roofs.

Figure 11:
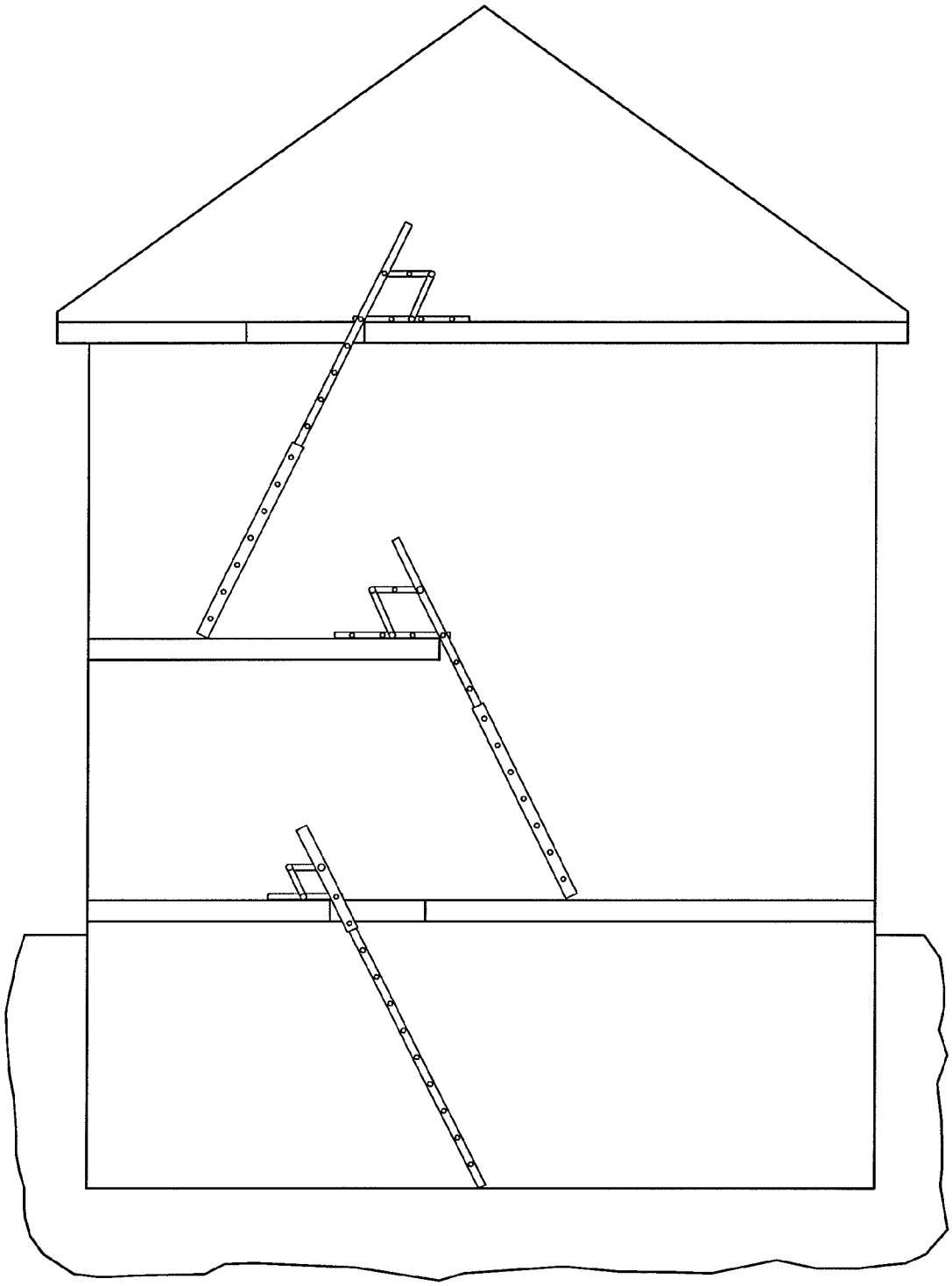
FIG. 11 is an embodiment which illustrates use of the invention on the interior of a building during construction.

In addition to roof applications, the collapsible platform assembly in accordance with the present invention can be used during construction. For example, as shown in FIG. 11, extension ladders with the collapsible platform assembly can be used in the early stages of home and building construction before stairs are installed between floors. As shown in FIG. 11, a first extension ladder and collapsible platform assembly is provided between the basement and the first floor. A second extension ladder and collapsible platform assembly is provided between the first floor and a second floor or loft. A third extension ladder and collapsible platform assembly is provided between the second floor or loft and the attic.

Figure 1:
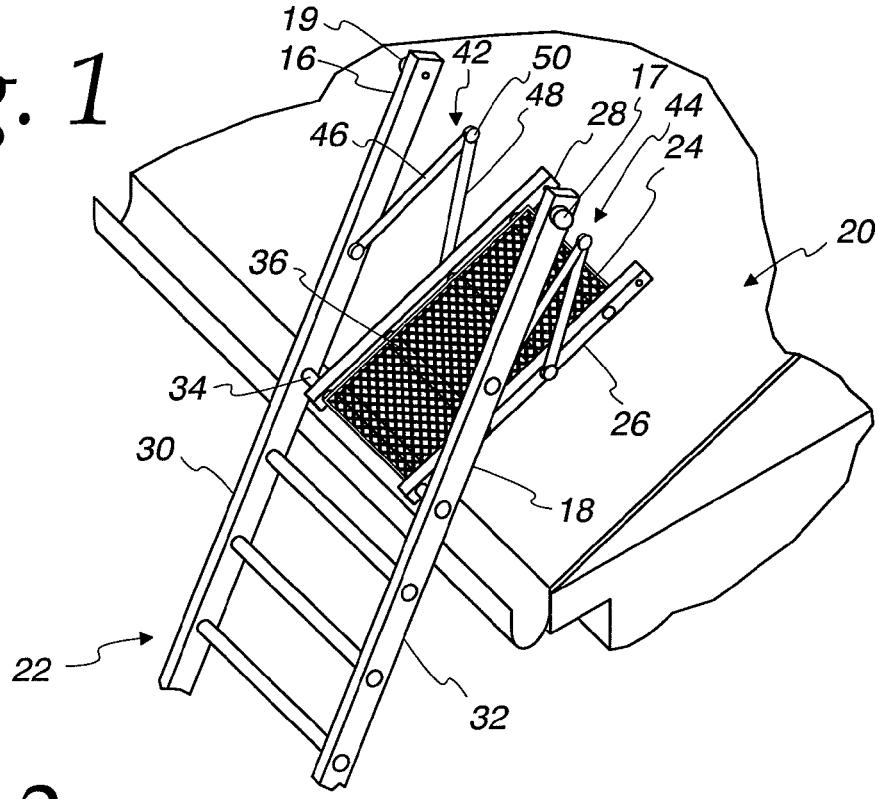
FIG. 1 is an isometric view of an extension ladder with one embodiment of the invention illustrating a collapsible platform assembly in accordance with the present invention shown in an extended position being supported by a roof, shown with a portion of the extension ladder and the roof cut away for clarity.
Figure 2:
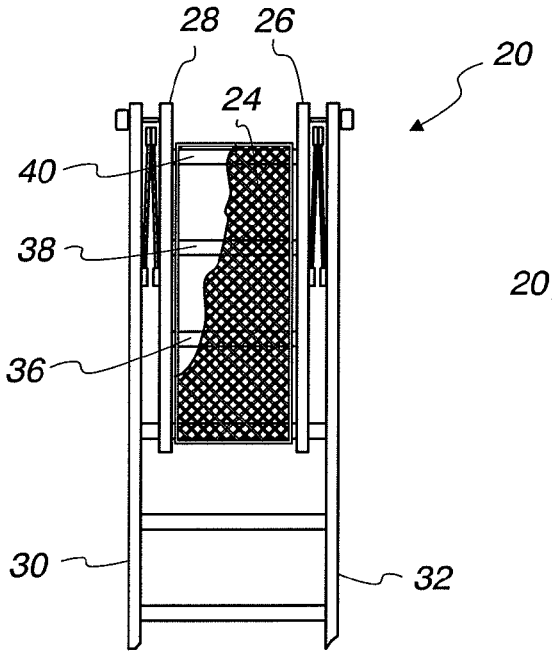
FIG. 2 is a front elevational view of the extension ladder and collapsible platform assembly illustrated in FIG. 1, shown with the collapsible platform in a storage or retracted position and with a portion of the extension ladder cut away.
Figure 3:
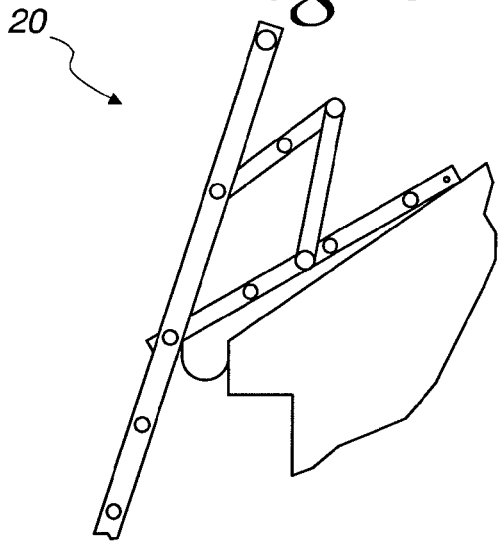
FIG. 3 is a side elevational view of the extension ladder and collapsible platform assembly illustrated in FIG. 1, shown with the collapsible platform in an extended position in an application of the invention in which the platform is generally parallel with a gable roof and with a portion of the extension ladder and the roof cut away.
Figure 6:
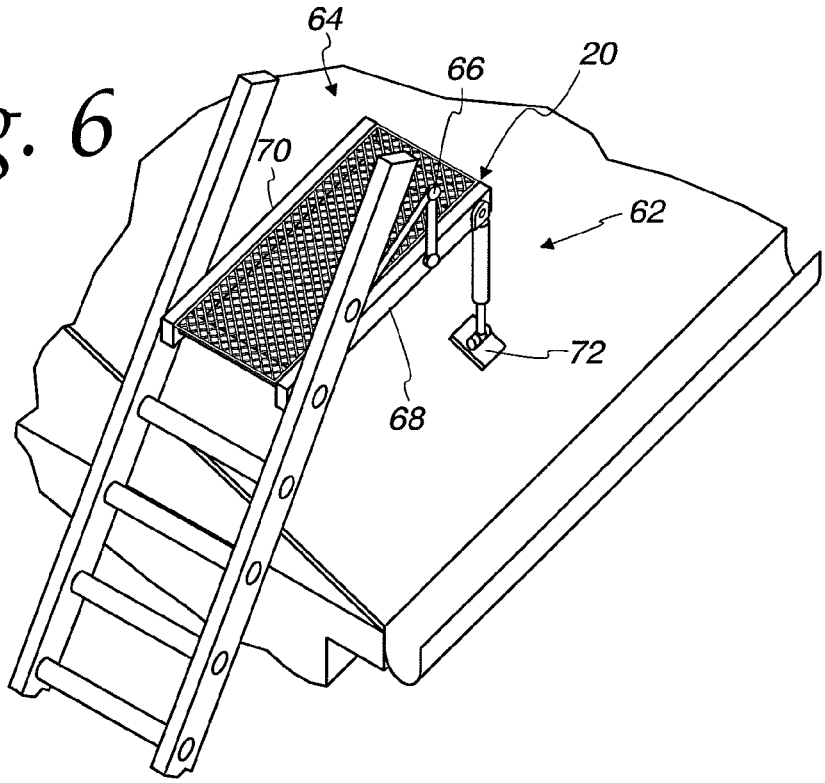
FIG. 6 is a an isometric view of an extension ladder with an alternative embodiment of the invention which includes a roof support leg and illustrates a collapsible platform assembly shown in an extended position being supported by the support leg, which, in turn, is supported by a roof, shown with a portion of the extension ladder and the roof cut away for clarity.
Figure 7:
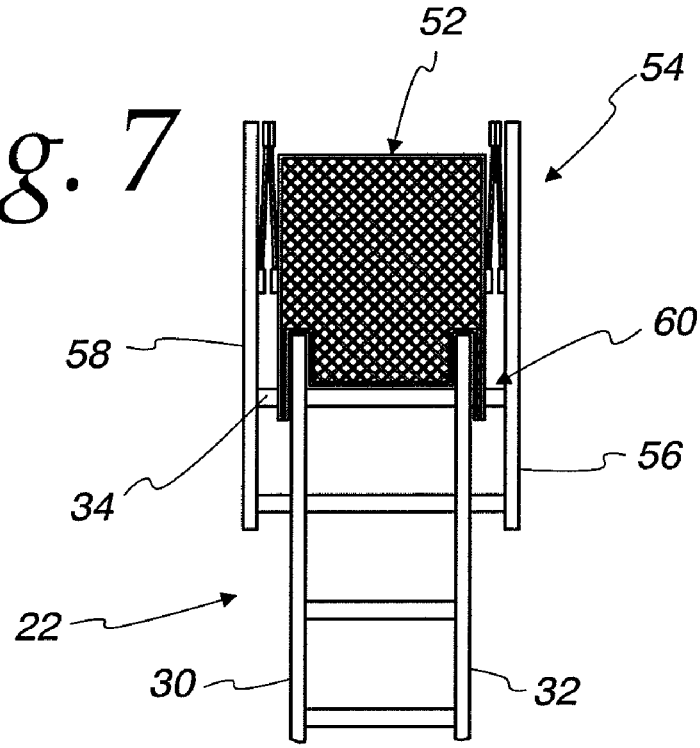
FIG. 7 is a front elevational view of the extension ladder and collapsible platform assembly in accordance with an alternate embodiment of the invention in which the collapsible platform assembly is configured as an add-on device shown being carried by an extension ladder in a storage or retracted position and with a portion of the extension ladder cut away.
Figure 8:
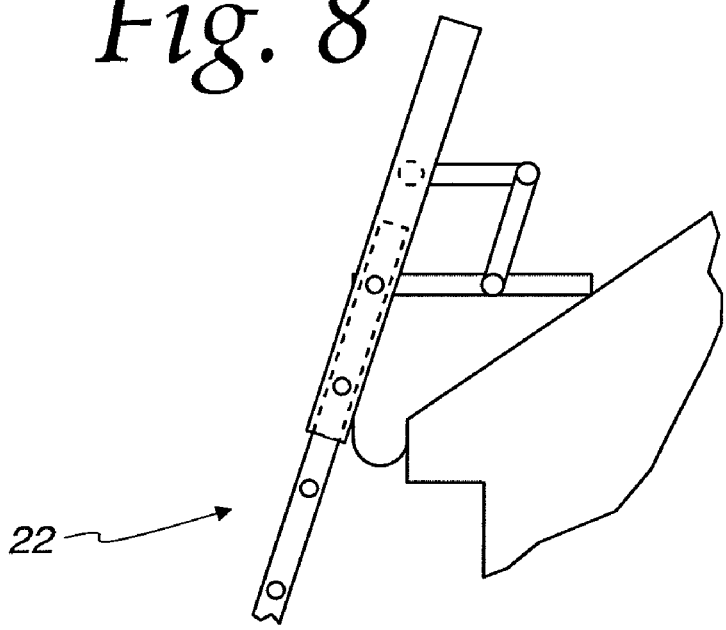
FIG. 8 is a side elevational view of the extension ladder and collapsible platform assembly illustrated in FIG. 7, shown with the collapsible platform assembly in an extended position in an application of the invention in which the free end of the platform rests on a gable roof and with a portion of the extension ladder and the roof cut away.

The collapsible platform assembly may be formed as part of the extension ladder or as an add-on device. FIGS. 1, 2 and 6 illustrate an embodiment in which the collapsible platform assembly is formed as part of an extension ladder. FIGS. 7 and 8 illustrate an embodiment of the invention in which the collapsible platform assembly is configured as an add-on device that is configured to be received and locked in place with respect to an extension ladder in a known manner.

An important aspect of the invention is the ability of the collapsible platform assembly to provide a support for the top of the ladder in a roof application. In each of the applications illustrated in FIGS. 1, 3, 4, 5, 6, and 8, the collapsible platform assembly includes a platform that is supported by the roof. More particularly, FIGS. 1, 3, 4, 5 and 8 illustrate an embodiment in which the platform is directly supported by the roof. FIG. 6 illustrates an embodiment in which the platform is indirectly supported by way of a leg that is secured to the platform. The collapsible platform is secured to the top of the extension ladder. Since the platform is configured to be directly supported by the roof, the platform acts as a rigid support for the top of the ladder. The platform is formed from suitable material to prevent deflection under load, e.g. a workman standing on the platform. Moreover, in use, there is an even weight transfer from the ladder to the platform further assuring that the platform will not deflect under load.

In accordance with another aspect of the invention, deflection of the ladder due to load will not cause the ladder to disengage from the platform as required by the above mentioned government regulations. In the embodiments illustrated in FIGS. 1, 2 and 6, the collapsible platform assembly is formed as part of an extension ladder. FIGS. 7 and 8 illustrate an embodiment in which the collapsible platform is configured as an add-on device that is configured to be received and locked in place in a known manner. As such, deflection of the ladder can not cause the ladder to become disengaged from the platform.

In accordance with another important aspect of the invention, the top portion of the collapsible platform assembly 20 forms "grab rails" when the collapsible platform assembly 20 is in an extended position, as shown in FIG. 1. In particular, when the collapsible platform assembly 20 is in an extended position, the upper portion of the side rails, identified with the reference numerals 16 and 18, extends well beyond the height of the roof. These upper portions of the side rails 16 and 18 allow a user to grab onto them and walk through the top portion of the ladder 22 and onto the platform 24. For added safety, collapsible hand rails may optionally be provided for use when the user moves onto the platform 24.

As shown in FIGS. 1, 3, 4, 5, 6, 8 and 9, the hand rails are amenable to virtually any application of the collapsible platform assembly. Although all of the illustrated embodiments of the collapsible platform assembly illustrate the use of hand rails, embodiments are contemplated in which the hand rails are not a part of the collapsible platform assembly.

Referring to FIGS. 1 and 2, a first embodiment of the collapsible platform assembly is illustrated and generally identified with the reference numeral 20. As mentioned above, in this embodiment, the collapsible platform assembly is integrally formed with an extension ladder 22. As shown, the collapsible platform assembly includes a platform 24, formed, for example, a metal plate or other material having a weight rating at least equivalent to the weight rating of the ladder 22.

The collapsible platform assembly 20 includes a pair of side rails 26 and 28. A plurality of rungs, identified with the reference numerals 36, 38 and 40 are connected between the side rails 26 and 28 in a conventional manner. The rung 34, connected to the bottom of the collapsible platform assembly 20, is connected to the side rails 30 and 32 of the extension ladder 22 causing the collapsible platform assembly 20 to be rotatably connected therewith. In a collapsed or storage position, as shown in FIG. 2, the free ends of the side rails 26 and 28 of the collapsible platform assembly 20 are aligned with the free ends of the side rails 30 and 32 of the extension ladder 22.

As shown, the platform 24 may be sandwiched between a pair of spaced apart side rails 26 and 28. The spacing between the side rails 26 and 28 as well as the width of the platform 24 is selected so that the collapsible platform assembly 20 fits between the side rails 30 and 32 of the extension ladder 22 and is co-planar therewith in a storage or retracted position as shown in FIG. 2.

Various means are contemplated for locking the collapsible platform assembly 20 in place with respect to the extension ladder 22. For example, as illustrated in FIG. 1, a pair of retractable spring-biased pins 17 and 19 may mounted near the top of the side rails 30 and 32. These retractable spring-biased pins 17 and 19 may be configured to be accessible by way of a knob from the outward sides of the side rails 30 and 32 and include pins that extend through apertures in the side rails 30 and 32. As such in a retracted position, the pins are drawn outwardly. The spring-loaded pins 17 and 19 are biased inwardly so that when the knobs are released, the pins extend inwardly beyond the interior surface of the side rails 30 and 32. Aligned apertures (not shown) are provided on the side rails 26 and 28 that form a part of the collapsible platform assembly 20. In a normal position the spring-biased pins 17 and 19 are received in the apertures in the side rails 26 and 28 to prevent rotation of the collapsible platform assembly 20 with respect to the ladder 22. The platform assembly 20 may be easily released by pulling outwardly on the knobs to enable the platform 24 to rotate and rest on the surface of a roof, as generally shown in FIG. 1. The collapsible platform assembly 20 may be secured with respect to the ladder 22 by rotating the collapsible platform assembly so that it is generally co-planar with respect to the side rails 30 and 32 of the extension ladder 22 and locked in place by the spring-biased pins 17 and 19.

Figure 9:
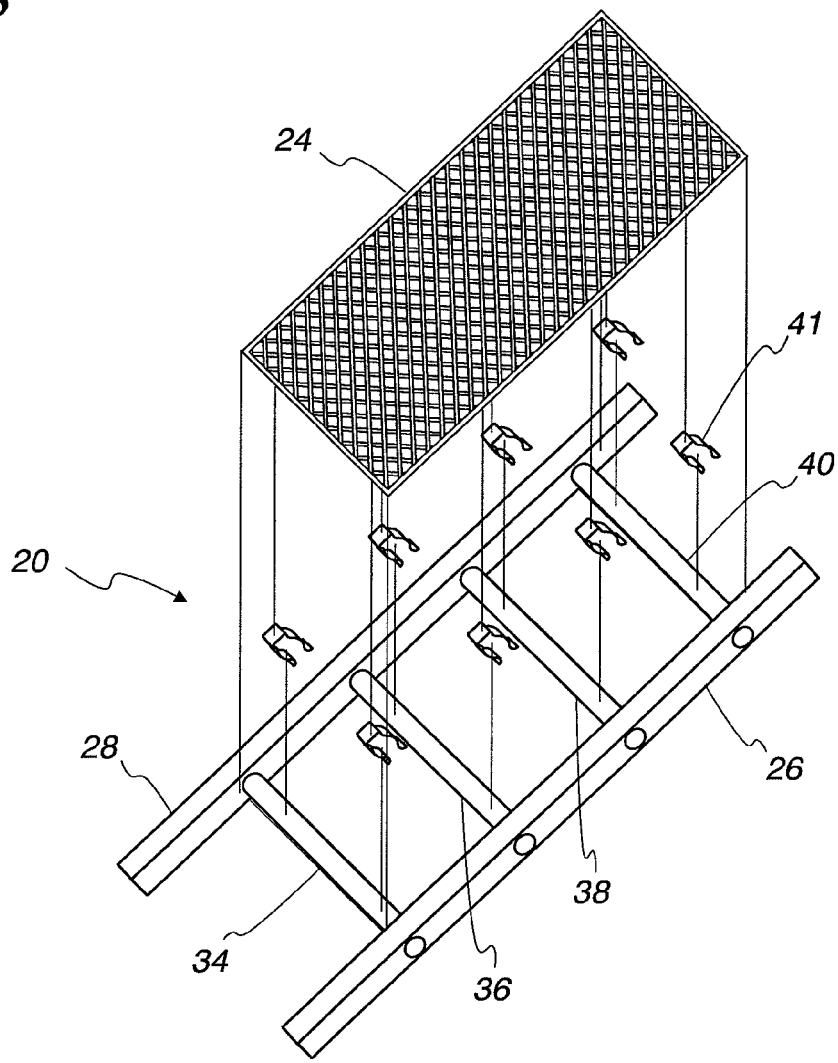
FIG. 9 is an exploded isometric drawing platform assembly in accordance with the present invention.
Figure 10:
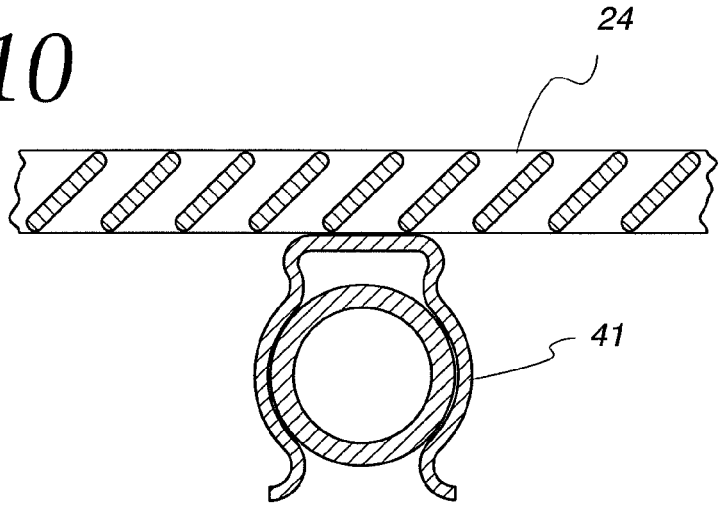
FIG. 10 is a side elevational view of the platform assembly illustrated in FIG. 9.

Various methods are contemplated for attaching the platform 24 to the rungs 36, 38 and 40 of the collapsible platform assembly 20 and the rung 34 of the extension ladder 22. For example, as best shown in FIGS. 8 and 9, the underside of the platform 24 may be provided with a number of C-shaped brackets 41 that are rigidly attached to the underside of the platform 24, for example, by welding or with fasteners. These brackets 41 may be formed as resilient members, for example, from spring steel and configured to receive the rungs 36, 38 and 40 of the collapsible platform assembly 20 and the rung 34 of the extension ladder 22. As such, the platform 24 is removable providing the option of the ladder being used with and without the platform 24.

In accordance with another important feature of the invention, the collapsible platform assembly may be provided with at least one collapsible hand rail. A pair of collapsible hand rails is illustrated in FIGS. 1 and 2, while FIG. 6 illustrates an embodiment with a single hand rail. Turning first to FIGS. 1 and 2, the hand rails are identified with the reference numerals 42 and 44. As shown, each hand rail 42, 44 may be formed as a two bar linkage, which includes two bar members 46 and 48, pivotally connected together in a known manner in an end to end relationship defining a hand rail assembly with a movable pivot point 50. The free end of one bar member 50 is pivotally connected to the side rail 30 of the extension ladder 22 in a known manner while the free end of the other bar member 48 is pivotally connected to the side rail 28 of the collapsible platform assembly 20 in a known manner. In an extended position, as shown in FIGS. 1, 3, 4, 5, 6 and 8, the two bar linkage forms a hand rail for use by a workman. In a collapsed or storage position, as shown in FIG. 2, the collapsible hand rails 42 and 44 are co-planar with the side rails 30 and 32 of the extension ladder 22.

In the embodiments illustrated in FIGS. 1, 2 and 6, the collapsible platform assembly is nested between the side rails 30 and 32 of the extension ladder 22. In the embodiment illustrated in FIGS. 7 and 8, the collapsible platform assembly 54 is formed as an add-on device and includes a platform 52 and a pair of side rails 56 and 58. In this embodiment the side rails 56 and 58 are disposed outside of the side rails 30 and 32 of the extension ladder 22. The platform 52 may be connected to the rungs 60 of the collapsible platform assembly 54 in a manner as described above. The collapsible platform assembly 54 may be connected to the side rails 30 and 32 of the extension ladder 22 as described above. FIG. 7 illustrates a collapsed or storage position while FIG. 8 illustrates a an extended position of this embodiment.

FIG. 6 illustrates another alternate embodiment in which one or more support legs 62 are pivotally connected to a collapsible platform assembly 64 having a platform 66 carried by a pair of spaced apart side rails 68 and 70. The support legs 62 enable the platform 66 to be supported in a level position, when the ladder is used in an application as illustrated in FIG. 6. In such an application, one corner of the platform 66 is supported by the roof. The other corner of the platform 66 is supported by the support leg 62. In this embodiment, the support legs 62 are pivotally connected to the side rails 68 and 70 of the collapsible platform assembly 64. The support legs 62 may include a flat foot that is coupled to the support leg 62 by way of, for example, a ball joint which allows the foot 72 to rotate in one or more directions. In use, in an extended position, the foot 72 is firmly seated against the roof.

Obviously, many modifications and variations of the present invention are possible in light of the above teachings. Thus, it is to be understood that, within the scope of the appended claims, the invention may be practiced otherwise than as specifically described above.

What is claimed and desired to be secured by a Letters Patent of the United States is:

1. A ladder formed with a collapsible platform assembly comprising:

a pair of spaced apart side rails;

a plurality of rungs including a top rung rigidly connected between said spaced apart side rails, wherein said side rails extend beyond said top rung and said extending portions of said side rails define grab rails to enable a user to walk between said side rails while holding on to said grab rails;

a platform rotatably connected directly to said top rung so as to be movable between a collapsed position in which said platform is co-planar relative to said side rails and an extended position in which said platform is not co-planar relative to said side rails to enable said platform to overhang a roof of a building when said ladder is disposed against a building and said top rung of said ladder is at an elevation higher than a lowest elevation of said roof; and a collapsible hand rail assembly including at least two links directly coupled together by a pivot and rotatably connected directly to said platform and rotatably connected directly to one of said side rails so that said hand rail assembly is movable between a storage position wherein said platform and said hand rail assembly are co-planar with said side rails and a use position in which said hand rail assembly is not co-planar with said side rails, said hand rail assembly including at least one hand rail to enable a user to hold on when said collapsible hand rail assembly is in said use position.

2. The collapsible platform assembly as recited in claim 1, further including at least one rotatably mounted support leg for supporting at least one corner of the platform.

3. The collapsible platform assembly as recited in claim 1, wherein said collapsible hand rail assembly is rotatably coupled to both of said side rails.

4. The collapsible platform assembly as recited in claim 1, further including a locking mechanism for locking said platform and said collapsible hand rail assembly in said storage position.

* * * * *